United States Patent [19]

Bolin et al.

[11] 4,255,667

[45] Mar. 10, 1981

[54] X-RAY SHIELD STAND

[76] Inventors: Leonard E. Bolin, 1460 E. Ave. N.E., Salem, Oreg. 97301; Randy L. Marcus, 214 S. 19th St., Springfield, Oreg. 97477

[21] Appl. No.: 44,594

[22] Filed: Jun. 1, 1979

[51] Int. Cl.[3] ..... G21C 11/00; G21F 1/00

[52] U.S. Cl. ..... 250/515; 250/505

[58] Field of Search ..... 250/515, 514, 510, 505, 250/503

[56] References Cited

U.S. PATENT DOCUMENTS

| | | | |
|---|---|---|---|
| 3,649,835 | 3/1972 | Brackenbrough et al. | 250/515 |
| 3,723,743 | 3/1973 | Brackenbrough et al. | 250/515 |
| 4,109,155 | 8/1978 | Tschunt et al. | 250/505 |
| 4,158,779 | 6/1979 | Rommel et al. | 250/515 |

*Primary Examiner*—Bruce C. Anderson

*Attorney, Agent, or Firm*—Kolisch, Hartwell & Dickinson

[57] ABSTRACT

Apparatus for shielding selected body areas of a person undergoing X-irradiation within an examination zone. The apparatus includes an upright post extending along a portion of the height of the person being X-rayed, and a plurality of shield assemblies which are shiftable along the post to different vertical positions. The assemblies are counterweighted to remain in stable, shiftable states at the positions to which they are moved. Each assembly includes a bracket which is shiftably mounted on the post, a bar which is secured to the bracket and which extends laterally therefrom, alongside the examination zone, and an arm-mounting member mounted on the bar for shifting therealong. Each assembly further includes a shield arm having an X-ray shield carried at one of its ends. This arm is removably mounted on the arm-mounting member, and selectively placeable thereon in an extended position, wherein the arm extends laterally into the examination zone, and an upright position, wherein the arm is out of the zone.

3 Claims, 4 Drawing Figures

X-RAY SHIELD STAND

BACKGROUND AND SUMMARY

The present invention relates to radiation shields, and in particular, to shield apparatus having a plurality of X-ray shields which may be placed at selected positions within an elongate X-ray examination zone.

It is one object of the present invention to provide apparatus for shielding selected body areas of a person undergoing X-irradiation in an elongate examination zone.

A more particular object of the invention is to provide apparatus including a plurality of X-ray shields which may be positioned independently within an examination zone, with such positioning being performable without the use of position-locking devices.

Yet another object of the invention is to provide such apparatus which has plural X-ray shields, each of which may be placed selectively at positions outside of, or extending into, an examination zone.

The present invention includes an upright post extending adjacent an elongate, upright examination zone, and a plurality of shield assemblies mounted for shifting along this post to different vertical positions. The assemblies are counterweighted to remain in stable, shiftable states at the positions to which they are moved. Each assembly includes a bracket slidably mounted on the post, a bar attached to, and extending laterally from the bracket, alongside the examination zone, and an arm-mounting member mounted on the bar for shifting therealong.

A shield arm mountable on each mounting member is selectively positionable between an extended position wherein the arm extends laterally into the examination zone, and an upright position, wherein the arm is out of the zone. With the shield arm in its extended position, an X-ray shield mounted at one end of this arm is shiftable relative to the arm-mounting member. Movement of the arm-mounting member relative to the bar, and movement of the shield arm relative to the arm-mounting member, occur in a substantially horizontal plane, and are performable without position-locking devices.

These and other objects and features of the present invention will become more fully apparent when considered with the following detailed description of a preferred embodiment of the invention, and the accompanying drawings, wherein.

DETAILED DESCRIPTION OF A PREFERRED EMBODIMENT OF THE INVENTION

Figure 1:
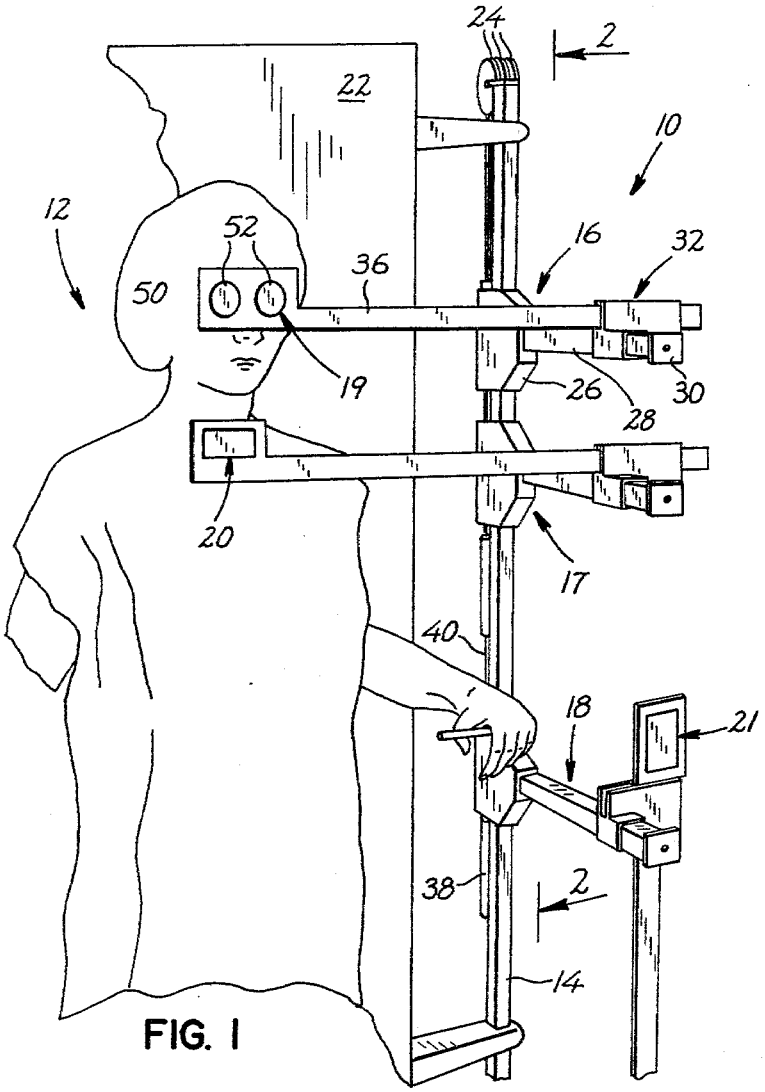
FIG. 1 is a fragmentary perspective view of shield apparatus constructed according to the present invention, shown here in operative condition with a pair of X-ray shields placed at preselected positions relative to a person being X-rayed within an examination zone.
Figure 2:
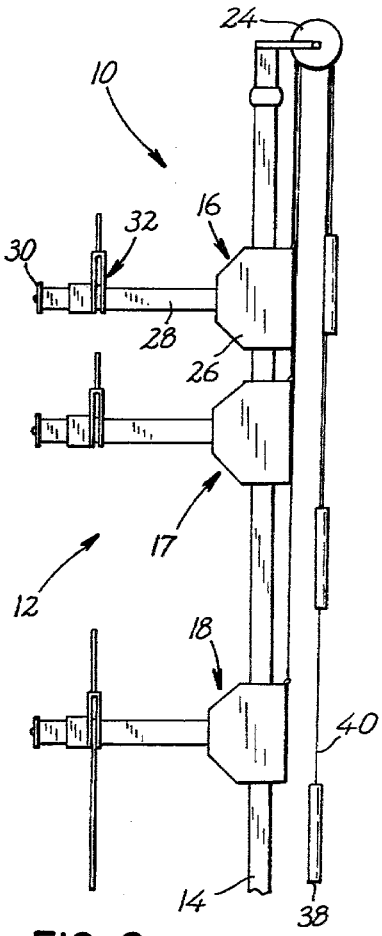
FIG. 2 is a side view of the stand shown in FIG. 1, taken generally along line 2—2 in FIG. 1.

Referring now to the drawings, and first, more particularly to FIGS. 1 and 2, there is shown at 10 apparatus for shielding selected body areas of a person undergoing irradiation by X-rays. As seen in FIG. 1, apparatus 10 is intended to provide X-ray shielding within an elongate examination zone, here indicated at 12.

Considering first the general features of apparatus 10, there are disclosed a stationary upright post 14 and a plurality of shield assemblies 16, 17, 18 which are mounted on post 14 for shifting therealong. Each assembly includes an X-ray shield, such as shields 19, 20, 21 associated with assemblies 16, 17, 18, respectively (FIG. 1). Each of the X-ray shields is positionable, within the examination zone, along each of three substantially mutually perpendicular axes, including the axis of post 14, in a manner to be described, and each is also placeable in an upright position out of the examination zone, as shown for shield 21 associated with assembly 18 in FIG. 1.

Looking now at details of apparatus 10, post 14 is a substantially square cross section, tubular post which is attached, adjacent its lower and upper ends in FIG. 1, to a suitable supporting wall or surface, indicated at 22. Post 14 has mounted adjacent its upper end, a plurality of pulleys 24, one for each shield assembly, for a purpose to be described.

Assemblies 16, 17, 18 are identical except for the particular X-ray shield in each, and thus only assembly 16 will be described herein. This assembly includes a bracket 26 which is mounted on post 14 for sliding therealong. An elongate bar 28 is attached, at one of its ends, to bracket 26, and extends laterally therefrom, in a substantially horizontal plane alongside the examination zone in a back-to-front direction with respect thereto. Bar 28 is formed of a hollow square tubular material similar to that used in post 14. The distal (near) end of the bar is capped with a restraining plate 30.

An arm-mounting member 32 is slidably mounted on bar 28 for movement therealong, with plate 30 acting to limit movement of member 32 beyond the bar's distal end. Shield 19 in assembly 16 is carried adjacent the end of a shield arm 36 which is removably mounted on member 32, and selectively placeable thereon, in a manner to be described.

Assembly 16 is counterbalanced by a counterweight 38 having roughly the same weight as the assembly. The assembly and counterweight are coupled by a line 40 attached adjacent one of its ends to bracket 26 and adjacent its other end to the counterweight, and trained over one of pulleys 24. Line 40 and the associated pulley 24 are also referred to herein as line means and pulley means, respectively. Counterweight 38, and the just-mentioned line and pulley means provide counterweight means operatively connected to bracket 26 for supporting assembly 16 in a stable, shiftable state at different assembly positions along post 14.

Figure 4:
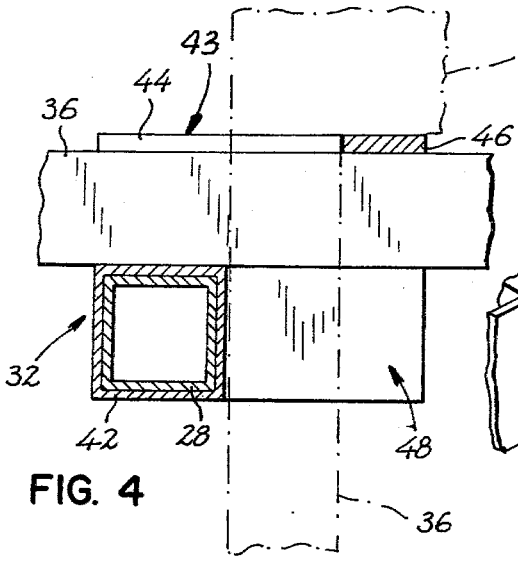
FIG. 4 is a cross section taken along line 4—4 in FIG. 3, in slightly reduced scale.
Figure 3:
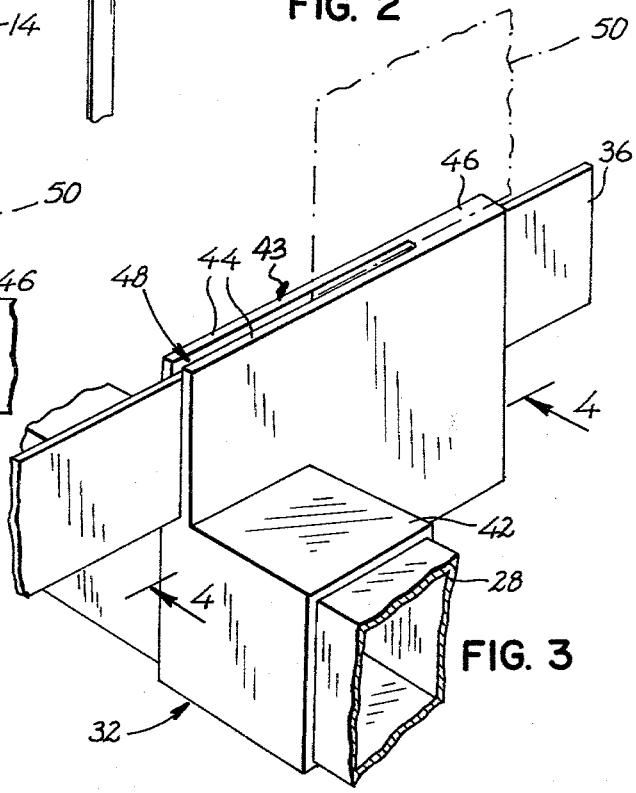
FIG. 3 is an enlarged view of an arm-mounting member forming part of the present invention, and fragmentary portions of an associated bar and shield arm.

With reference to FIGS. 3 and 4, member 32 is an integrally formed, preferably molded plastic unit which includes a tubular sleeve 42 and an arm-mounting structure 43. Sleeve 42 is dimensioned to fit snugly but slidably about bar 28, wherein movement of the member along the bar is resisted frictionally. Bar 28 and sleeve 42 form means shiftably mounting structure 43 on bracket 26.

Referring to FIGS. 3 and 4, structure 43 is formed of a pair of parallel, spaced-apart plates 44 mounted on (and preferably integrally formed with) sleeve 42 as shown. As seen best in FIG. 4, plates 44 and surface portions of sleeve 42 form an inverted L-shaped slot 48 having an elongate upper portion within which arm 36 is guided. The axis of slot 48, along which bar 36 extends, is normal to bar 28. A brace 46 connecting upper edge portions of plates 44 serves a purpose to be described.

Arm 36 is an elongate bar dimensioned to be received within slot 48 slidingly and somewhat snugly. Formed integrally with arm 36, adjacent one end thereof, is a rectangular plate 50 on which shield 19 is mounted (FIG. 1). This shield includes a pair of circular lead plates 52, which are dimensioned, and relatively spaced, to shield an examinee's eyes. Other sizes and shapes of lead plates, such as those forming shields 20, 21, are also contemplated in the present invention.

According to an important feature of the invention, a shield arm may be mounted releasably on an associated arm-mounting member in an extended position, as for assemblies 16, 17 in FIGS. 1 and 2, and in a substantially upright position, as for assembly 18 in these figures. As seen in FIG. 1, a shield arm extends into the examination zone, in its extended position, and is out of the examination zone in its upright position. As seen in FIG. 4, arm 36 is braced, in its extended position, between an upper edge portion of sleeve 42 and brace 46. The arm is supported in its upright position by plate 50 resting on brace 46, as shown in dash-dot lines in FIGS. 3 and 4.

In operation, the person to be examined stands within zone 12, adjacent apparatus 10, as shown in FIG. 1. Typically, there are provided, but not shown here, adjustable body-contacting bars which can be moved toward and away from the shoulder and hip regions of the person within the examination zone, to hold the person in a substantially fixed position therein. The source of X-rays is located to the left of the apparatus in FIG. 2, and in front of the person shown in FIG. 1, and X-ray film is mounted behind the person. As can be appreciated with reference to FIG. 1, the incident X-rays are directed toward the examinee, in a generally front-to-back direction with respect to the examination zone, substantially normal to the planes of the shields.

In the examination situation illustrated in FIG. 1, it is desired to protect the eyes and lower neck region of the person being examined. To position shields 19, 20 adjacent these body areas, assemblies 16, 17 are positioned along post 14 to vertical positions corresponding to such areas. As noted above, the counterweight associated with each assembly, allows the same to be placed at a selected position merely by sliding the assembly along post 14.

With assemblies 16, 17 placed at suitable positions along post 14, the associated shield arms are placed in extended positions, and shifted, relative to the associated arm-mounting members, to place the associated shields in front of the body areas desired to be protected. To complete the desired placement of each shield, the arm-mounting member therefore is shifted on the associated bar to a position wherein the associated shield is suitably spaced from the body area to be protected.

From the foregoing, it can be appreciated how the above-mentioned objects of the present invention are met. The invention provides one or more X-ray shields which may be positioned—by shifting along any of three mutually perpendicular paths—to desired positions within an examination zone. The shields are selectively positionable without the use of fasteners, clamps or the like, such as are required in prior art shield apparatus. Additional X-ray shields may be utilized or not, by shifting additional shield arms between extended and upright positions, respectively.

Viewing the combined advantages of the apparatus, it is clear that an X-ray technician can set up quickly and easily one or more X-ray shields adjacent selected body areas to be protected, and the positions of the shields can be changed quickly, according to instructions by a physician. Improved efficiency of X-ray examinations is therefore made possible.

Many changes within the scope of the above disclosure may be made to accommodate special installation and use requirements. For example, the bars, such as bar 28 may be attached for horizontal swinging (out of the way, and against a wall) in their respective brackets, like bracket 26. Also, one or more of the bars could be hinged intermediate the ends for horizontal "folding" around a patient. Other changes will become obvious to those skilled in the art.

An X-ray shield apparatus having a plurality of X-ray shields which are positionable easily and quickly at desired locations within an examination zone, to protect selected body areas of a person undergoing X-irradiation, has thus been disclosed. Various modifications and changes in the apparatus may be made without departing from the spirit of the invention.

It is claimed and desired to secure by Letters Patent:

1. Apparatus for shielding selected body areas of a person undergoing, in an elongate, upright examination zone, irradiation by X-rays directed into the zone in a generally front-to-back direction, said apparatus, in operative condition relative to said zone, comprising an upright post extending along a substantial portion of the zone, a plurality of shield assemblies mounted on said post for shifting relative thereto, each of said assemblies including, a bracket slidably mounted on said post for placement in different selected positions therealong corresponding to the height in said zone of one such body area, counterweight means shiftably mounted on said post and connected to said bracket to counterbalance the weight of the associated assembly at different positions along said post, an arm-mounting structure having an elongate slot, means mounting said structure on said bracket for placement in different selected positions along such direction, with the axis of said slot oriented horizontally and substantially perpendicular to said direction, a shield arm slidably carried in said slot for movement with respect to said structure along said axis, and an X-ray shield mounted on said arm.

2. The apparatus of claim 1 wherein said mounting means includes an elongate bar secured to said bracket and extending laterally therefrom, substantially along said direction, and said arm-mounting structure is mounted on said bar for shifting therealong.

3. The apparatus of claim 1, wherein said arm is shiftable in said slot between an extended position extending along said axis and an upright position substantially paralleling said post, and said structure includes a brace rigidly mounted adjacent said slot for bracing said arm in its extended and supporting said arm in its upright position.

* * * * *

UNITED STATES PATENT AND TRADEMARK OFFICE

CERTIFICATE OF CORRECTION

PATENT NO. : 4,255,667

DATED : March 10, 1981

INVENTOR(S) : LEONARD E. BOLIN and RANDY L.MARCUS

It is certified that error appears in the above-identified patent and that said Letters Patent are hereby corrected as shown below:

In column 4, line 64, after "extended" insert --position--.

Signed and Sealed this

*Ninth* Day of *February 1982*

[SEAL]

*Attest:*

GERALD J. MOSSINGHOFF

*Attesting Officer*

*Commissioner of Patents and Trademarks*